US010413153B2

(12) United States Patent
Detko

(10) Patent No.: US 10,413,153 B2
(45) Date of Patent: Sep. 17, 2019

(54) WASHING AGENT DISPENSING DEVICE FOR A DISHWASHER

(71) Applicant: BITRON POLAND SP.Z O.O., Sosnowiec (PL)

(72) Inventor: Lukasz Detko, Niegowonice (PL)

(73) Assignee: BITRON POLAND SP. Z O.O., Sosnowiec (PL)

( * ) Notice: Subject to any disclaimer, the term of this patent is extended or adjusted under 35 U.S.C. 154(b) by 0 days.

(21) Appl. No.: 15/677,753

(22) Filed: Aug. 15, 2017

(65) Prior Publication Data

US 2018/0049619 A1 Feb. 22, 2018

(30) Foreign Application Priority Data

Aug. 17, 2016 (PL) ..... P.418378

(51) Int. Cl.

| | |
|---|---|
| ***A47L 15/00*** | (2006.01) |
| ***A47L 15/44*** | (2006.01) |
| ***B08B 3/02*** | (2006.01) |
| ***B08B 13/00*** | (2006.01) |

(52) U.S. Cl.
CPC ..... *A47L 15/4409* (2013.01); *A47L 15/0021* (2013.01); *B08B 3/02* (2013.01); *B08B 13/00* (2013.01)

(58) Field of Classification Search
CPC ... A47L 15/0021; A47L 15/4409; B08B 3/02; B08B 13/00
USPC ..... 134/56 D, 57 D, 58 D, 93, 104.2, 198
See application file for complete search history.

(56) References Cited

U.S. PATENT DOCUMENTS

2012/0138101 A1* 6/2012 Francisco ..... A47L 15/0028 134/25.2

* cited by examiner

*Primary Examiner* — Levon J Shahinian
(74) *Attorney, Agent, or Firm* — Sughrue Mion, PLLC

(57) ABSTRACT

A dispensing device (1) is to be mounted in a wall (W) of a rotatable door (D) associated with the washing chamber (WC) of a dishwashing machine, wherein in said washing chamber (WC) there is rotatably mounted at least one spraying impeller (S) adapted to periodically address a flow (F) of washing liquid towards a portion of said wall (W) above the dispensing device (1).

2 Claims, 7 Drawing Sheets

WASHING AGENT DISPENSING DEVICE FOR A DISHWASHER

CROSS REFERENCE TO RELATED APPLICATION

This application claims priority from Polish Patent Application No. P.418378 filed Aug. 17, 2016, the contents of all of which are incorporated herein by reference in their entirety.

BACKGROUND OF THE INVENTION

Field of the Invention

The present invention relates to a dispensing device for dispensing at least one washing agent, for instance in powder or tablet form, or the like, to be mounted in a wall of a rotatable door associated with the washing chamber of a dishwashing machine, wherein in said washing chamber there is rotatably mounted a spraying impeller adapted for periodically emitting a flow of a washing liquid towards a portion of said wall of the door, above the dispensing device.

Background

More specifically, the present invention relates to a dispensing device comprising a support body intended to be fixed in said wall of the machine door and in which there is defined an essentially cup-like receptacle, adapted to receive an amount or dose of a washing agent and having an opening with an associated movable cover, which can be closed manually when said door is open and can be opened under control during a washing cycle, when said door is closed, for dispensing towards said chamber the washing agent contained in the receptacle.

Dispensing devices of this type are known, for example, from German patent application DE 197 57 679 A1, international patent application WO 2012/107886 A1 and innumerable other documents.

In many cases, such a washing agent dispensing device is integrated with a further dispenser, adapted to contain a plurality of doses of a rinse agent or rinse aid, typically in a liquid form.

In dispensing devices produced up to now, the cover associated with the receptacle for the washing agent is opened under control during a washing cycle, by energising an actuator device, for example a solenoid device, a wax motor device, or a device using a wire of shape memory material. The receptacle is, in particular, shaped so that when the associated cover is opened, the detergent or washing agent contained in the receptacle falls by gravity and is poured into the washing chamber of the dishwashing machine.

With dispensing devices of this type, it is not uncommon to find that, owing to various factors, the washing agent or detergent does not dissolve completely or, in some cases, does not dissolve at all. This evidently compromises the effectiveness of the dishwashing action.

SUMMARY OF THE INVENTION

One object of the present invention is therefore to provide a dispensing device for dispensing at least one washing agent, by means of which the aforementioned drawbacks of the prior art dispensing device can be overcome.

This and other objects are achieved according to the invention with a dispensing device of the type initially specified, characterised in that in the wall of the receptacle which in use, when the machine door is closed, is placed at the top there is provided at least one passage which puts the region inside said receptacle in communication with an overlying region, which extends outside said receptacle and in which said cover extends in part both in its open condition and in its closed condition, and in that the cover and said support body are shaped and coupled with each other such that in said overlying region above the receptacle there is permanently defined therebetween at least one conduit adapted to enablew a flow of washing liquid, emitted by said spraying impeller and trickled on said wall of the machine door, to reach the inlet of said passage.

BRIEF DESCRIPTION OF THE INVENTION

Further features and advantages of the present invention will become apparent from the following detailed description, which is given purely by way of a non-limiting example, with reference to the attached drawings, wherein.

DETAILED DESCRIPTION OF THE INVENTION

Figure 1:
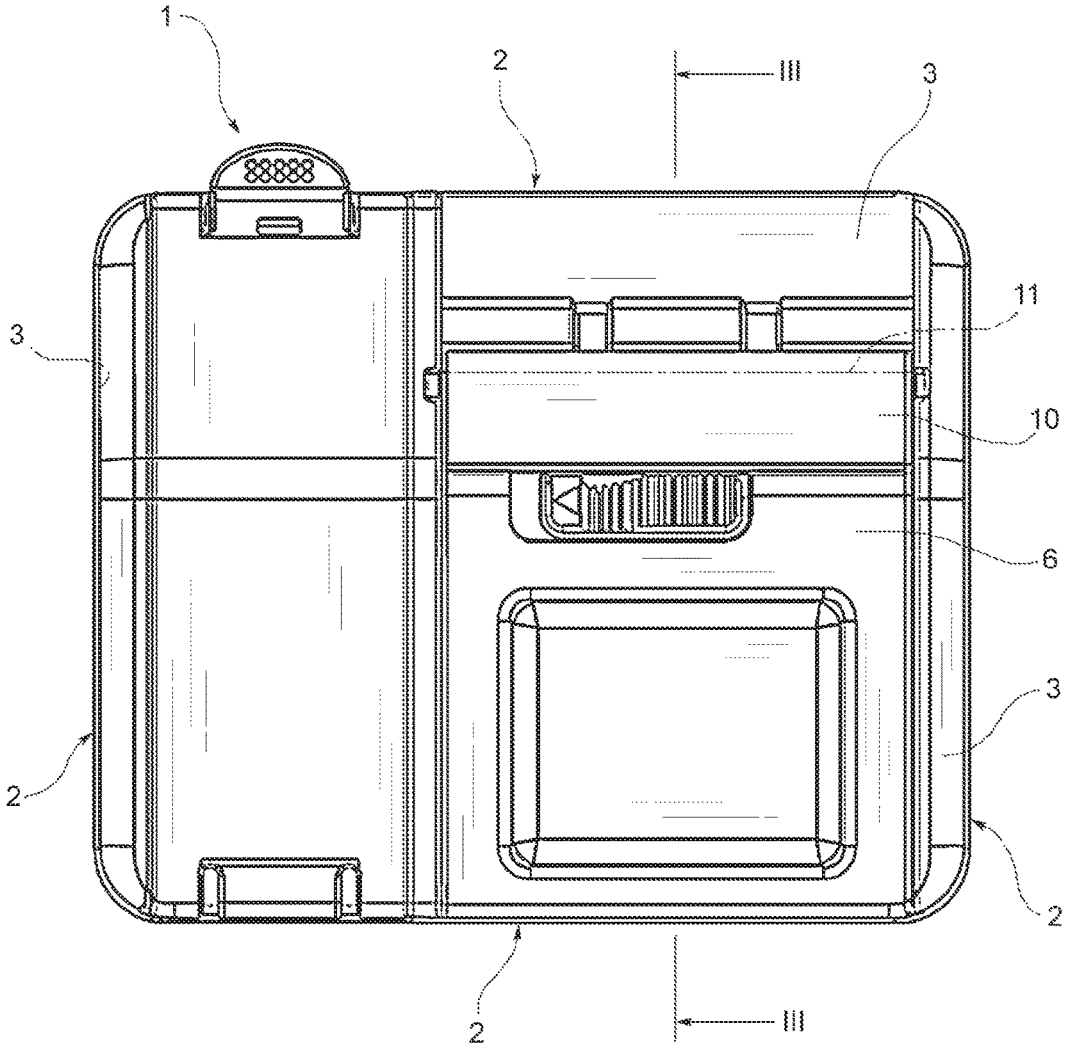
FIGS. 1 and 2 are a front and a rear view, respectively, of a dispensing device according to the present invention.

In the drawings, the reference number 1 indicates the whole of an integrated dispensing device including a dispenser of washing agent or detergent according to the present invention.

Figure 5:
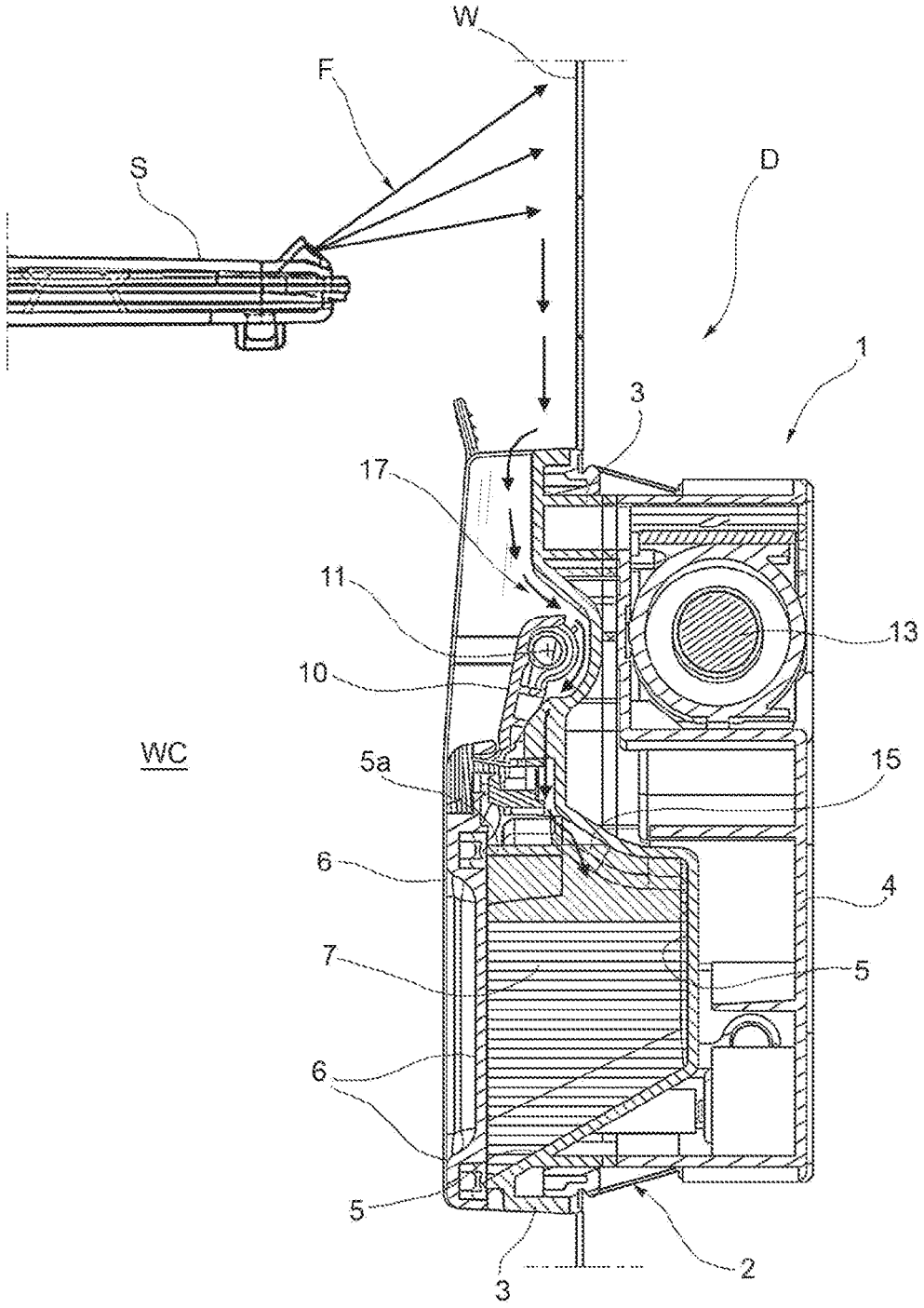
FIGS. 5 to 7 are partial sectional views showing three successive phases of the operation of a dispensing device according to the present invention.
Figure 6:
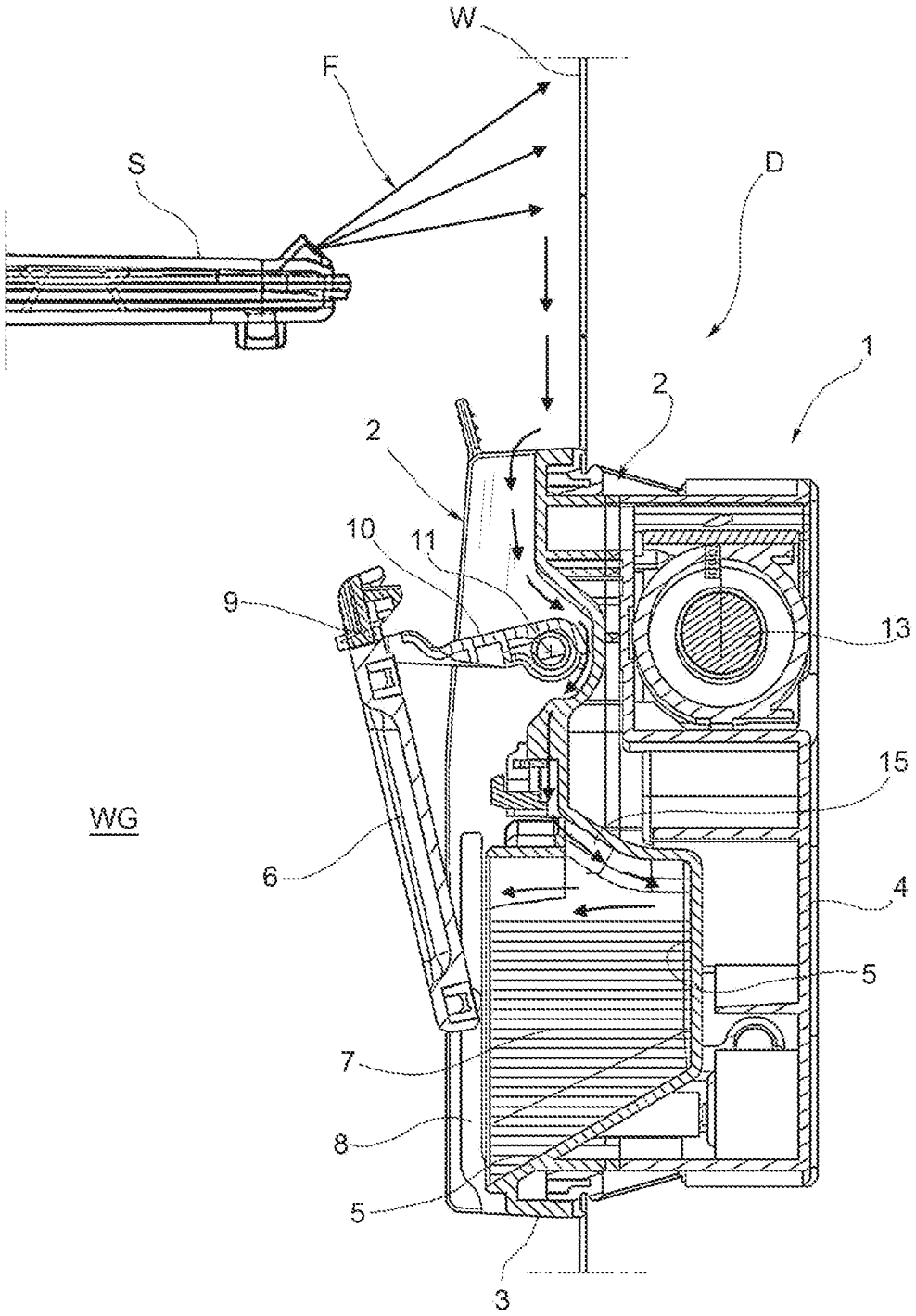
Figure 7:
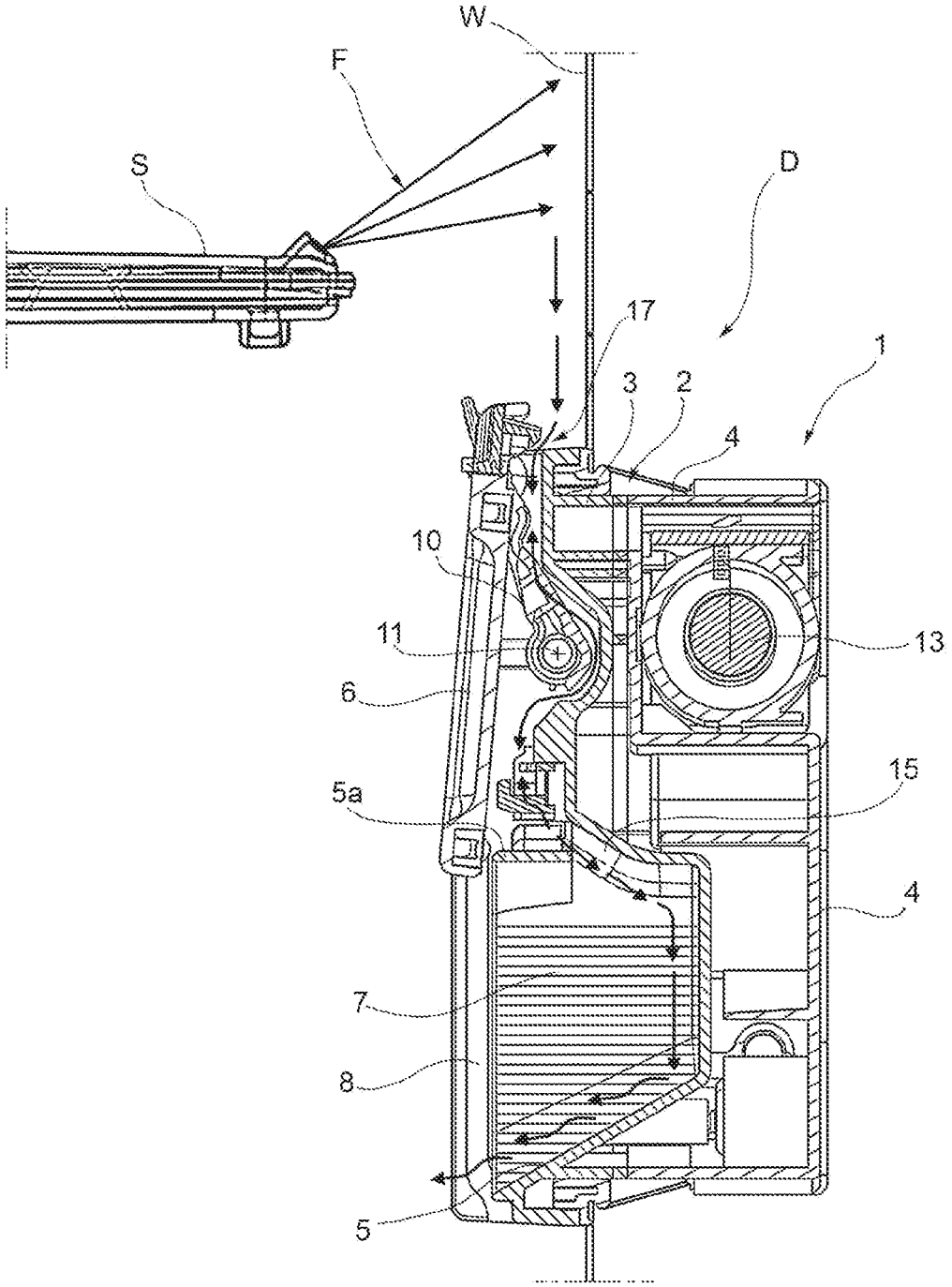

In a per se known manner and as it is illustrated in FIGS. 5 to 7, such an integrated dispensing device 1 is intended to be fixed to the inner wall W of the rotatable front door D of a dishwashing machine.

As will be more clearly apparent from the following description, although the attached drawings show an integrated dispensing device also comprising a dispenser of rinse agent or rinse aid, the present invention is evidently not limited to the embodiment of the washing agent dispenser in a form in which it is integrated with such a further dispenser of rinse agent.

The door of a dishwashing machine is usually pivoted on the body of the machine along its lower side and may be placed in an open position, in a substantially horizontal condition (the loading/unloading position) for the arrangement of dishes to be washed in the washing chamber, or the removal of dishes after washing.

In the closed position, the door is instead in an essentially vertical condition (the operating condition) and closes the washing chamber of the machine in a water-tight manner.

The integrated dispensing device 1, being mounted in the door D of a dishwashing machine, is also movable in use between a horizontal loading position, in which it can be loaded with an amount of washing agent or detergent and, if necessary, with a plurality of doses of rinse agent or rinse aid, and an operating or working position in which said device is placed vertically facing the washing chamber WC and can be activated to dispense the detergent or washing agent and then one or more amounts of doses of rinse agent during an operating cycle of the machine.

With reference to FIGS. 5 to 7, in the washing chamber WC of the dishwashing machine there is mounted at least one spraying impeller S, rotatable about a vertical axis, which cyclically directs a flow F of washing liquid towards a portion of the inner wall W of the door D, above the position wherein the dispensing device 1 is mounted.

In the exemplary embodiment shown in the drawings the integrated dispensing device comprises a support body 2, made for instance of a plastic material, intended to be mounted in a corresponding opening provided in the inner wall W of the door D of a dishwashing machine, said wall facing the washing chamber WC.

The body 2 can be made in two parts, for instance with a main front part 3 and an auxiliary rear part 4, both made by injection moulding and subsequently interconnected and heatwelded, using a hot blade device for example (see FIGS. 3 and 4). The rear part 4 may also be made of a material which is at least partially transparent.

In the body 2 there is formed an essentially cup-shaped receptacle 5, intended to contain an amount of washing agent or detergent, in powder or tablet form, or other forms.

Figure 3:
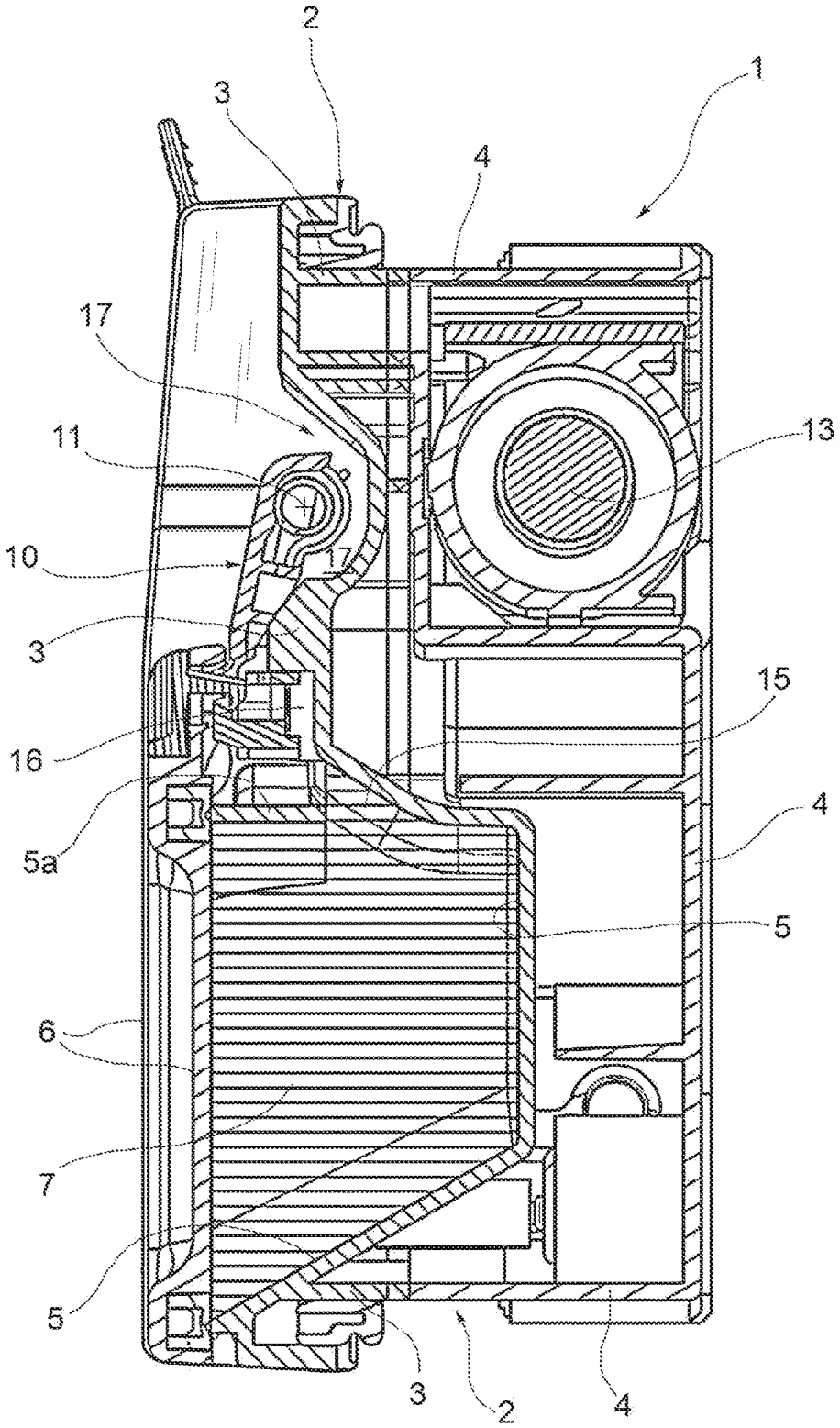
FIG. 3 is a sectional view taken along the line III-III of FIG. 1.
Figure 4:
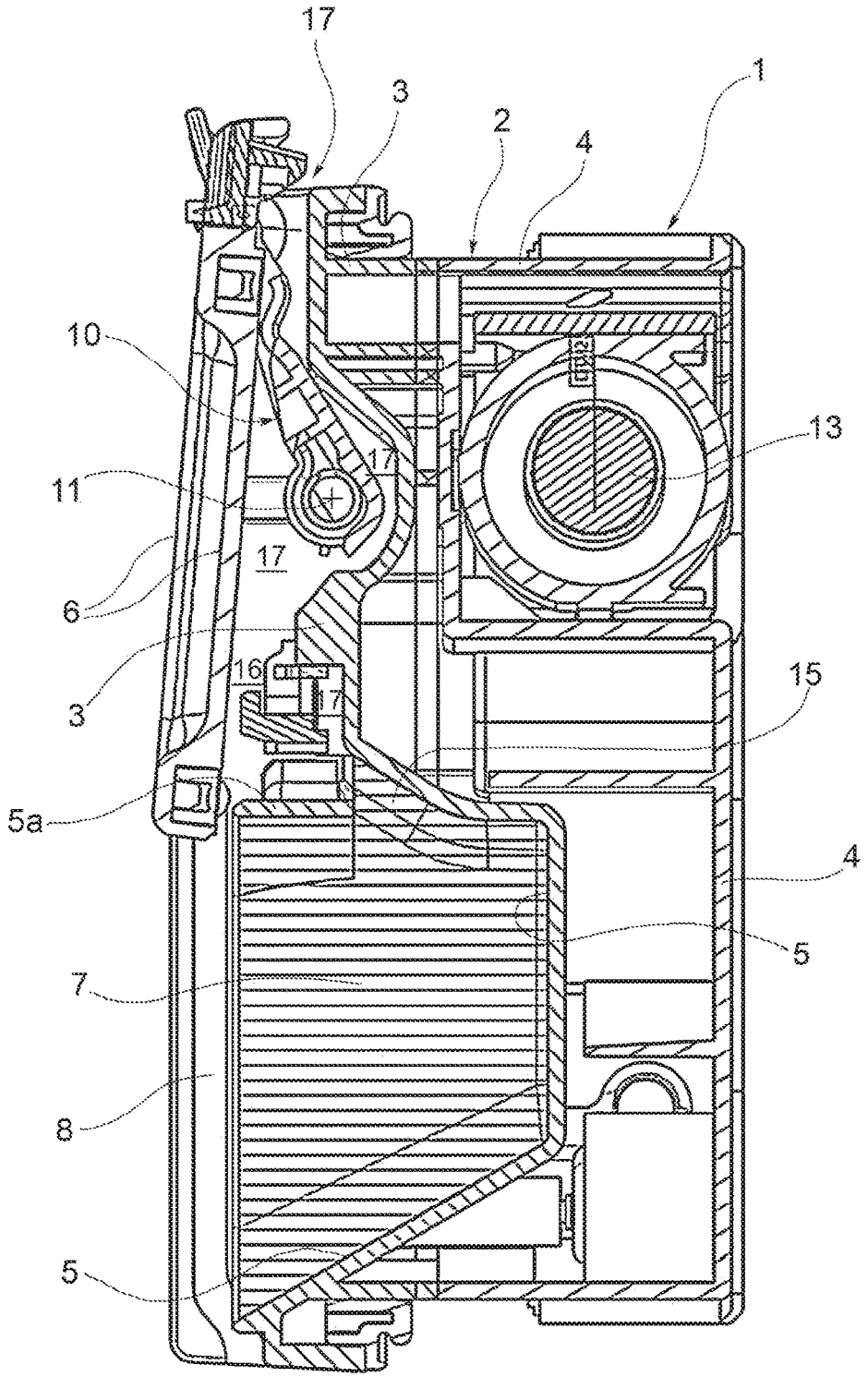
FIG. 4 is a sectional view similar to that presented in FIG. 3 and shows the cover of the receptacle for the washing agent or detergent in ist open position.

To the receptacle 5 there is associated a cover 6, which can assume, in a per se known manner, a closed position shown in FIGS. 1, 3 and 5 and an open position shown in FIGS. 4 and 7.

In FIG. 6 the cover 6 is shown in an intermediate position, through which it passes in its displacement between the open position and the closed position.

As it is shown in FIGS. 3 and 5, in the receptacle 5 there is disposed an amount of a washing agent 7, for instance a detergent in powder. Although in FIG. 4 the washing agent 7 appears as filling the entire volume of the receptacle 5, such a condition is not strictly necessary.

In a per se known manner, the ends of the lower side of the cover 6 are slidingly engaged in respective, essentially vertical, guide grooves 8, predisposed in the support body 2, only one of which is visible in FIGS. 4, 6 and 7.

At its horizontal side, the cover 6 is articulated in 9 (FIG. 6) to a crank-like rotatable member 10, about a horizontal axis 11, with respect to the support body 2.

In the illustrated embodiment, the cover 6 can pass from the closed position (FIGS. 3 and 5) to the open position (FIGS. 4 and 7) through a composite displacement of rotation-translation, passing through a series of intermediate positions, one of which is that shown in FIG. 6.

In a per se known manner, when the door D of the dishwashing machine is in its open position the cover 6, which at the end of a washing cycle is in an at least partially open condition, can be brought manually back to its closed position, after an amount or dose of washing agent has been placed in the receptacle 5, for the execution of a new washing cycle.

When the door D of the dishwashing machine is closed, the dispensing device 1 assumes the operating position shown in FIGS. 3 and 5, in which it is in an essentially vertical condition.

Figure 2:
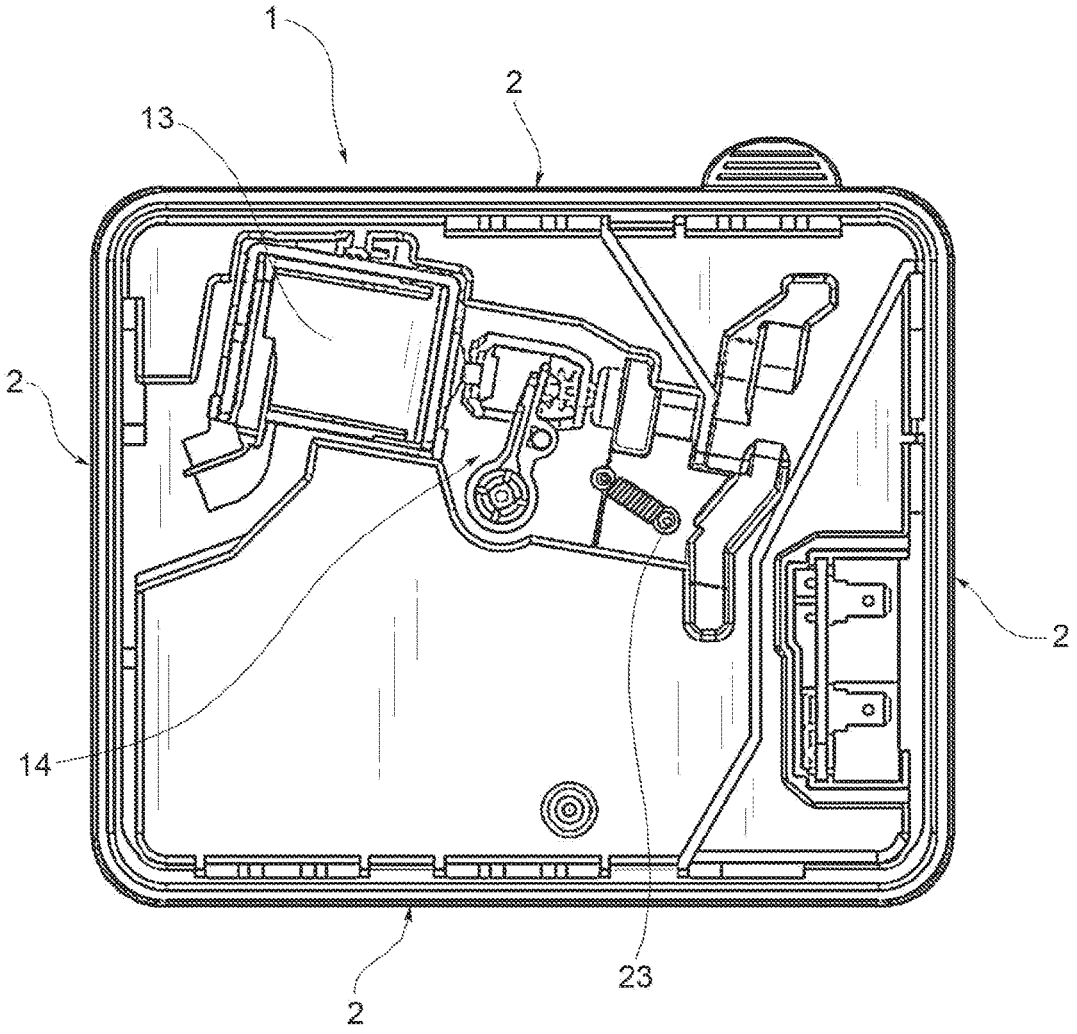

For the purpose of causing the opening of the cover 6, the dispensing device 1 comprises an electrically operated actuator 13 (FIGS. 2 and 3 to 7) of a per se known type, for example including a solenoid. Said actuator 13 is adapted to cause the opening of the cover as a consequence of its own interaction with a mechanism 14 (FIG. 2) which is of a known type and is therefore not further described herein.

With reference to FIG. 3 (door D of the washing machine open) the receptacle 5 has an upper wall 5*a* in which there is provided a passage 15 which puts the receptacle in communication with an overlying region 16, which extends outside said receptacle 5, and in which region the cover 6 partially extends both in its closed condition (FIG. 3) and in its open condition (FIG. 4).

The cover 6 and the support body 2 are shaped and coupled with one another such that in said region 16 above the receptacle 5 there is permanently defined therebetween at least one conduit 17, adapted to allow a flow of washing liquid, coming from the impeller S (FIGS. 5 to 7) and trickling down along the inner wall W of the door D, to reach the region inside the receptacle 5, flowing through the above-described passage 15, as it is illustrated by a sequence of arrows pointing downwards in FIGS. 5 to 7.

The arrangement is such that during a washing cycle, when the cover 6 of the dispensing device 1 is still closed (FIGS. 3 and 5), the amount F of washing liquid periodically directed by the spraying impeller S towards an upper portion of the inner wall W of the door D of the dishwashing machine, flows down on said wall W and enters the conduit 17 defined between the support body 2, the crank member 10 and the cover 6, and through the passage 15 reaches the receptacle 5, where it causes an at least partial dissolution/dilution of the washing agent 7 contained therein.

When in a washing cycle the opening of the cover 6 is controlled through the actuator 13, during the displacement of said cover towards the open position (FIG. 6) the mixture of washing agent 7 and washing liquid starts leaving the receptacle 5 towards the washing chamber WC, as it is illustrated in FIG. 6.

When the opening of the cover 6 is completed (FIG. 7), the further jets or flows F of washing liquid which impinge against the wall W above the dispensing device 1 also reach the receptacle 5, further dissolving the washing agent or detergent contained therein and draining it towards the washing chamber WC.

Thanks to the innovative solution described above, the dispensing of the washing agent or detergent is considerably improved.

Consequently, also the effectiveness of the dishwashing action is improved.

Clearly, provided that the principle of the invention is retained, the forms of construction and the details of embodiment can be varied widely from what has been described herein purely by way of a non-limiting example, without thereby departing from the scope of the invention as defined by the attached claims.

The invention claimed is:

1. A dispensing device for dispensing at least one washing agent, to be mounted in a wall of a rotatable door associated with a washing chamber of a dishwashing machine, wherein in said washing chamber there is rotatably mounted at least one spraying impeller adapted to periodically address a flow of washing liquid towards a portion of said wall of the door above said dispensing device;

the dispensing device comprising a support body intended to be fixed to said wall of the door and in which there is defined a cup-like receptacle adapted to receive an amount or dose of a washing agent and having an opening associated with a movable cover, which can be closed manually when said door is open and can be opened under control during a washing cycle for dispensing towards said chamber the washing agent contained in the receptacle;

wherein the dispensing device comprises an upper wall of the receptacle which in use, when said door is closed, is in a top portion of the receptacle, wherein at least one passage is provided, said upper wall being interposed between said cover and said at least one passage, said at least one passage posing the region inside said receptacle in communication with an overlying region which extends outside said receptacle, in which overlying region the cover extends in part both in its open condition and in its closed condition, and wherein the cover and said support body are shaped and coupled with one another such that in said overlying region extending above the receptacle there is permanently defined therebetween at least one conduit adapted to allow a flow of washing liquid, coming from said impeller and trickled downwards on said wall of the door, to reach an inlet of said passage.

2. The dispensing device according to claim 1 wherein, in a closed position of the cover, the cover is in contact with the upper wall, preventing thereby the washing liquid from passing between the cover and the upper wall.

* * * * *